United States Patent [19]

Massaro et al.

[11] 4,400,917

[45] Aug. 30, 1983

[54] ARCH PREFORM AND METHOD OF CONSTRUCTING ARCH PASSAGEWAY

[76] Inventors: Bruno Massaro, 1534 Dunbar Hill Rd.; Vincent Massaro, 375 Wintergreen Ave., both of Hamden, Conn. 06514

[21] Appl. No.: 228,157

[22] Filed: Jan. 23, 1981

[51] Int. Cl.[3] ..... E04B 1/32

[52] U.S. Cl. ..... 52/86; 52/211; 52/745

[58] Field of Search ..... 52/86, 204, 211, 213, 52/745; D25/60

[56] References Cited

U.S. PATENT DOCUMENTS

| | | | |
|---|---|---|---|
| 1,619,631 | 3/1927 | Patasnik | D25/60 X |
| 2,005,572 | 6/1935 | Vass | D25/60 X |
| 2,011,796 | 8/1935 | Christensen | D25/60 X |
| 2,064,704 | 12/1936 | Vass | 52/213 X |
| 3,421,269 | 1/1969 | Medow | 52/211 |
| 3,511,006 | 5/1970 | Medow | D25/60 X |
| 3,842,557 | 10/1974 | Brown | D25/60 X |
| 4,202,143 | 5/1980 | Mear et al. | 52/204 X |
| 4,301,632 | 11/1981 | Wagner | 52/211 |

*Primary Examiner*—J. Karl Bell
*Attorney, Agent, or Firm*—DeLio & Libert

[57] ABSTRACT

A unitary structure for and a method which facilitates the construction of an arch-shaped passageway. The invention can be employed in conjunction with drywall construction materials and in a method to construct an arch-shaped passageway from a rectangular passageway.

7 Claims, 5 Drawing Figures

ARCH PREFORM AND METHOD OF CONSTRUCTING ARCH PASSAGEWAY

BACKGROUND OF THE INVENTION

This invention relates to a new and improved structure which facilitates the construction of an arch-shaped passageway and a method for constructing an arch-shaped passageway. This invention is particularly applicable to drywall construction in the housing construction industry.

Arch passageways, in general, undoubtedly date from earliest historic times. While the end product, i.e. arch-shaped passageway, cannot be characterized as novel, economic considerations dictate that the construction of arch-shaped passageways, which are now primarily constructed for aesthetic reasons, be accomplished by new and improved methods and/or new and improved materials and structures.

The patent literature contains many references to devices, structures, and methods for obtaining arch-shaped passageways. Much of the literature such as U.S. Pat. No. 2,442,929, No. 2,005,572, No. 1,782,147, and No. 1,979,701 is directed to arch passageway construction in conjunction with plaster/lath construction which has become largely obsolete. Other prior art such as U.S. Pat. No. 2,064,704 disclose an arch passageway construction which requires the assembling of a number of elements and is thus disadvantageous from the standpoint of labor costs. The deficiencies of the prior art primarily rest on the failure to provide arch passageway construction which is adaptable to mass construction techniques which minimize labor costs.

In general the present invention is an advancement over the prior art by virtue of the use of a relatively inexpensive unitary arch structure which can be installed quickly and easily and can be finished by conventional modern construction techniques.

SUMMARY OF THE INVENTION

The present invention comprises a unitary structure of two parallel substantially identical panels, in which the bottoms of the panels have an arcuate boundary. A third panel extends between the arcuate boundaries of the first two panels. The structure is dimensioned so that the structure may be positioned at the top of a rectangular door frame to form an arch passageway. The panels are of a thin structure so that a surface continuum between the door frame and/or the wall and the arch structure may be obtained by conventional drywall taping techniques.

OBJECTS OF THE INVENTION

An object of this invention is to provide a new and improved unitary structure for facilitating the construction of arch-shaped passageways.

Another object of this invention is to provide a new and improved method for constructing an arch-shaped passageway which can be accomplished quickly and easily.

A further object of this invention is to provide a new and improved structure and a new and improved method for construction of an arch-shaped passageway which employs materials and methods employed in drywall construction.

Other objects and advantages will become apparent from the detailed description and accompanying drawings.

DETAILED DESCRIPTION

Figure 1:
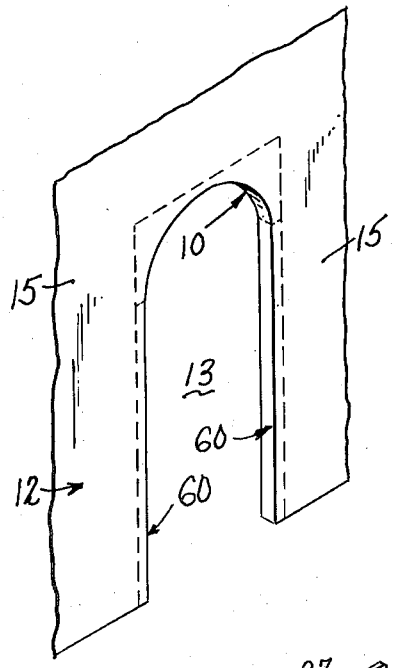
FIG. 1 is a perspective view of an arch-shaped passageway.

The present invention is directed to facilitating the construction of an arch-shaped passageway such as the interior passageway between rooms of a residential structure as illustrated in FIG. 1, wherein dashed lines indicate the position of structures employed in the invention, including an arch preform 10, which are incorporated to form the finished passageway. The invention may be employed in the construction of a wide variety of passageways including windows and can be employed in both interior and exterior construction. However, the preferred environment of the invention is in the construction of interior passageways in residential housing.

Figure 2:
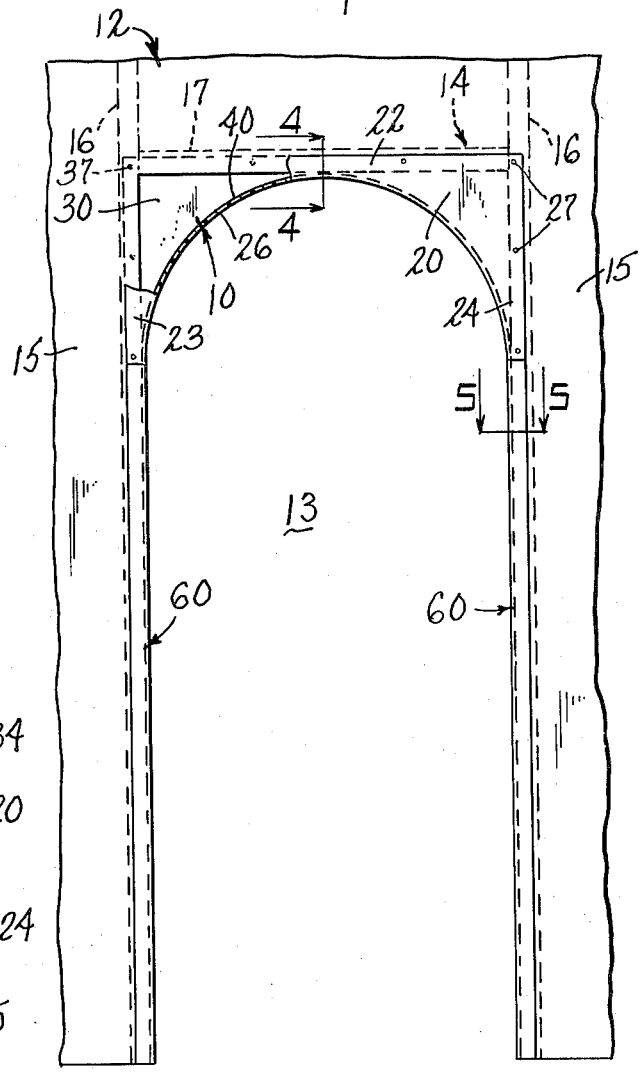
FIG. 2 is a front elevational view of a passageway, partly in section, showing an arch preform structure in relation to the passageway.

With reference to FIG. 2, a wall 12 having a substantially rectangular passageway 13 therethrough is illustrated in combination with the structural components of the invention. Passageway 13 is defined by a frame 14 which for purposes of describing the invention, may be viewed as a substantially rectangular frame of uniform thickness. Thickness, for purposes of description, is the dimension analogous to and commensurate with the thickness of wall 12.

Figure 4:
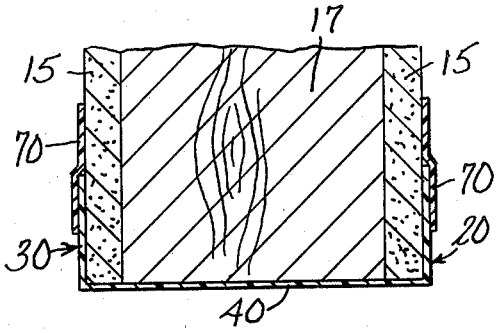
FIG. 4 is a sectional view along the line 4—4 of FIG. 2.
Figure 5:
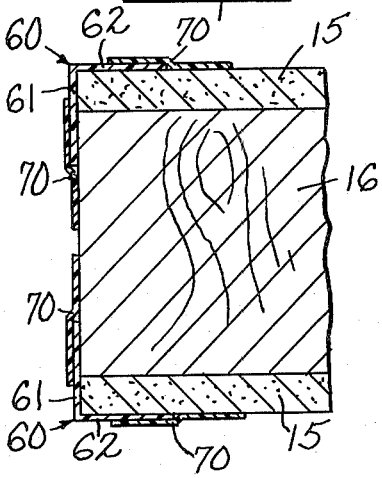
FIG. 5 is a sectional view along the line 5—5 of FIG. 2.

Frame 14 may comprise a pair of vertical studs 16 and a horizontal stud 17 or header interposed between vertical studs 16. As shown in FIGS. 4 and 5, drywall panels 15, such as sheetrock or plasterboard, extend to cover the faces of studs 16 and 17 which are substantially parallel to the wall. It will be readily appreciated that the foregoing description is representative of typical drywall construction, which construction is referenced for purposes of describing the invention and is not to be viewed in a limiting sense.

Figure 3:
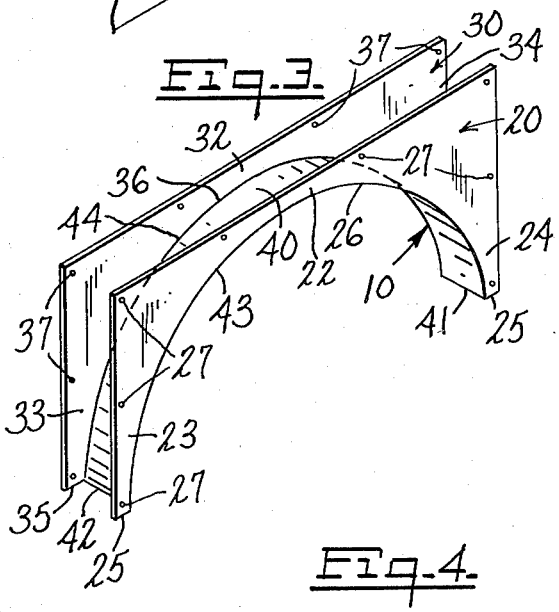
FIG. 3 is a perspective view of the arch preform.

With reference to FIG. 3, arch preform 10 is a unitary structure comprising a front panel portion 20, a substantially identical rear panel portion 30, and an arcuate panel portion 40 interposed between portions 20 and 30.

Front panel portion 20 comprises a sheet of material of uniform thickness, the shape of which may be described as a substantially rectangular sheet, from which a portion defined by the intersection of an arcuate boundary and a linear boundary, has been symmetrically removed. Front panel portion 20 thus is defined by side edges 23 and 24, a top edge 22 and bottom edges 25, the latter being separated by an arcuate boundary 26. In a preferred form, side edges 23 and 24 are parallel and equal and also perpendicular to top edge 22 and bottom edges 25 as shown in FIG. 3.

Rear panel portion 30, which is parallel to the front panel portion 20, is preferably of a shape and dimensions identical to front panel portion 20. Rear panel portion 30 is thus defined by sides 33 and 34, top 32, bottom portions 35, and arcuate boundary 36. Alternate embodiments of the arch preform may encompass preforms wherein the size and shape of panel portions 20 and 30 are different. However, it is a particular constraint of the present invention that arcuate boundaries 26 and 36 are substantially congruent.

Arcuate panel portion 40 comprises a sheet of material of uniform thickness and width having arcuate edges 43 and 44, which intersect arcuate boundaries 26 and 36, so that arcuate panel portion 40 is substantially orthogonal to portions 20 and 30. Arcuate panel portion 40 is further defined by ends 41 and 42, which extend between panel portions 20 and 30, and intersect at or proximate corresponding bottom edges 25 and 35.

The arch preform 10 is preferably constructed of Fiberglass or other materials which allow for the panel portions to be relatively thin. A preform having front and rear panel portions thickness dimensions on the order of 1/16th inch, and arcuate panel portion thickness dimensions on the order of 1/8th inch, is suitable. The thickness of the panel portions is governed by the parameters of constructing the preform as thin as possible, to minimize the outward protrusion from the wall when positioned, as described below, while providing for sufficient rigidity of the preform.

With further reference to FIGS. 2 and 3, the dimensional constraints of the preform are dictated by the interior dimensions of the passageway frame 14. Ends 41 and 42 are dimensioned to be substantially equal to the thickness of the passageway frame 14. As can be seen from the specific construction illustrated in FIG. 4, the length of ends 41 and 42 in that example would be equivalent to the width of the stud 17 plus twice the thickness of the drywall panel 15. Because the studs and drywall panels generally occur in standard sizes, the dimension of the ends need only be restricted to a few standard lengths. The distance between ends 41 and 42 is substantially equal to the width of the passageway frame, which, as illustrated in FIG. 2, is the distance between studs 16. Conventional construction usually employs standard passageway construction of 36 inch, 48 inch, 60 inch, or 72 inch widths. It can thus be seen that a relatively few number of standard size preforms will accommodate the vast majority of passageways.

The preform 10 may be installed by positioning the preform at the top of the passageway frame. The front and rear panel portions proximate the sides and tops extend to contact against opposing faces of the wall and/or passageway frame proximate the top of the passageway, so that ends 41 and 42 engage firmly against the sides of frame 14.

The preform is then secured in position. This may be accomplished by either gluing the preform by applying adhesive to the backs of the panel portions 20 and 30 and pressing the portions against the wall and/or frame, or by nailing the preform to the wall and/or frame or by other suitable means. Opposing faces of the front and rear portions which face toward each other may comprise a rough surface or a plurality of perforations to facilitate adhesion. A plurality of nail holes 27 and 37 proximate the sides and tops of the panel portions may facilitate the securing of the preform in place.

It will be appreciated that correct positioning can be ascertained when ends 41 and 42 engage against the passageway sides and the top of the arcuate boundary or midpoint of the arcuate panel 40 engages against the horizontal stud. If the panel portions are substantially identical and of the substantially symmetrical form illustrated in FIG. 3, the preform will be relatively easy to correctly position. Because the preform can be manufactured from fiberglass or other material which allows for some degree of deformability or flexibility, it is possible to adjust the preform to allow for slight construction variations.

As illustrated in FIG. 4, upon positioning of the preform, the edges of the preform extend outward slightly from the wall surface. In order to obtain a smooth surface finish, and establish a wall continuum between the preform and the wall, cement or taping compound and drywall tape may be applied along the outer portions of the preform, in a manner analogous to conventional drywall taping procedures. Two inch tape is suitable. It may be necessary to sand and apply multiple applications of taping compound and tape to obtain the desired finish.

The preform may also be employed in combination with corner pieces 60 as illustrated in FIGS. 2 and 5. The corner pieces may be constructed of a material similar to that of the preform and of a thickness substantially equal to the thickness of the panel portions 20 and 30 of the preform. Corner pieces 60 extend from the floor to the bottom edges 25 and 35 of the preform. Each corner piece 60 further comprises a face 61 which is orthogonal to face 62 and is adapted to position against the corners of the passageway studs 16 which studs define the intersection of the wall/frame with the sides of the passageway. The corner pieces can be either glued or nailed in a manner similar to the securing of the preform. A corner piece/frame/wall continuum can be obtained by taping along the entire length of both outer portions of the corner piece from the floor to the top of the preform.

Both the corner piece and preform can then be painted and/or primed for painting. It is noted that after securing the preform and/or corner pieces in position, all finish work can be accomplished by conventional techniques and using conventional materials.

It can thus be seen that the invention provides for the efficient and inexpensive construction of an arch-shaped passageway which can be employed in conjunction with conventional building and construction techniques, and the objects of the invention are efficiently attained.

While preferred embodiments of the invention have been set forth for purposes of disclosure, modification of the disclosed embodiments of the invention as well as other embodiments thereof, may occur to those skilled in the art. Accordingly, the appended claims are intended to cover all embodiments of the invention which do not depart from the spirit and scope of the invention.

What I claim is:

1. An arch preform for facilitating the construction of an arch passageway from a passageway defined by a substantially rectangular frame, having a top, two sides, a front face and a rear face, said preform comprising:

a front panel portion and a rear panel portion, each of said panel portions being defined by a top edge, two side edges, and a bottom edge partially constituted by a substantially arcuate boundary, said panel portions being substantially flat and parallel;

a substantially arcuate panel portion extending between said front and rear panel portions adjacent said arcuate boundaries and integral therewith;

each of said three panel portions being comprised of a sheet of material of substantially uniform thickness, said thickness being small relative to the distance between said front and rear panel portions, and said panel portions being dimensioned so that said preform may be positioned at the top of the passageway defined by said frame whereby said front and rear portions engage against the corresponding front and rear faces of the frame and said arcuate panel portion extends between the sides of the frame and passes closely adjacent to the top of the frame.

2. The preform of claim 1, wherein said arcuate panel portion further comprises a pair of ends, the length of said ends being substantially equal to the distance between the front and rear faces of the rectangular frame.

3. The preform of claim 2, wherein the distance between said ends is substantially equal to the distance between the sides of said frame.

4. The preform of claim 1 wherein the material is Fiberglass and the thickness of the material of said front and rear portions is on the order of 1/16" and the thickness of said arcuate portion is on the order of $\frac{1}{8}$".

5. A method of construction of an arch passageway from a passageway opening through a wall defined by a rectangular frame having a top and two sides, the wall and frame having front and rear faces, and the method comprising:

(a) positioning the preform of claim 1 at the top of the frame so that the front and rear portions of the preform engage against corresponding faces of the wall and the arcuate panel portion extends between the sides of the frame;

(b) securing said preform in position; and (c) applying a tape along the outer edges of said preform to form a surface continuum of the wall, frame, and preform.

6. The method of claim 5 further comprising the steps of positioning a corner piece at each of the corners constituted by the the sides of the frame and the faces of the wall, each of said corner pieces being an elongated strip of material dimensioned to extend from the floor to the bottom portion of the positioned preform, said strip having an L-shaped cross-section, the thickness of said material being substantially uniform and commensurate with the material of the preform, and applying a tape along the edges of said corner pieces to form a surface continuum of said wall, said corner pieces, said frame and said preform.

7. In combination:

(a) a passageway defined by a rectangular frame, having a top, bottom, two sides, a front and rear face;

(b) an arch preform positioned at the top of said frame, said preform comprising:

a front portion and a rear portion, each of said portions being defined by a top edge, two side edges and a bottom edge partially constituted by an arcuate boundary, said portions being substantially parallel, and engaging against the corresponding front and rear faces of the frame, an arcuate panel portion extending between said arcuate boundaries, and between the sides of said frame, each of said portions being comprised of a sheet of material of substantially uniform thickness, said thickness being small relative to the distance between said front and rear portions; and (c) corner pieces, each extending from the bottom of the frame to the bottom of said preform and engaging against a face and side of said frame proximate the intersection of said side and said face, said pieces further comprising:

an enlongated strip of material, said strip having an L-shaped cross-section, the thickness of said strip being substantially uniform and commensurate with the thickness of the material of the preform.

* * * * *

UNITED STATES PATENT AND TRADEMARK OFFICE

CERTIFICATE OF CORRECTION

PATENT NO. : 4,400,917

DATED : August 30, 1983

INVENTOR(S) : Bruno Massaro and Vincent Massaro

It is certified that error appears in the above-identified patent and that said Letters Patent are hereby corrected as shown below:

Col. 2, line 68, delete "sides" before "33" and substitute --side edges--

Col. 2, line 68, insert --edge-- between "top" and "32"

Col. 3, line 1, delete "portions" and substitute --edges--

Col. 3, line 16, add quotes to "Fiberglass"

Col. 3, line 48, delete "opposing" and substitute --opposite--

Col. 5, line 19, add quotes to "Fiberglass"

Signed and Sealed this

*Fifteenth* Day of *November 1983*

[SEAL]

*Attest:*

GERALD J. MOSSINGHOFF

*Attesting Officer*

*Commissioner of Patents and Trademarks*